US008723615B2

(12) United States Patent
Nishida et al.

(10) Patent No.: US 8,723,615 B2
(45) Date of Patent: May 13, 2014

(54) NON-RECIPROCAL CIRCUIT DEVICE AND RADIO COMMUNICATION TERMINAL DEVICE

(71) Applicant: Murata Manufacturing Co., Ltd., Nagaokakyo (JP)

(72) Inventors: Hiroshi Nishida, Nagaokakyo (JP); Noboru Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/961,969

(22) Filed: Aug. 8, 2013

(65) Prior Publication Data

US 2013/0321091 A1 Dec. 5, 2013

Related U.S. Application Data

(63) Continuation of application No. PCT/JP2012/055636, filed on Mar. 6, 2012.

(30) Foreign Application Priority Data

Mar. 16, 2011 (JP) ..... 2011-057790

(51) Int. Cl.
*H01P 1/387* (2006.01)
*H01P 1/383* (2006.01)

(52) U.S. Cl.
USPC ..... 333/1.1; 333/24.2

(58) Field of Classification Search
USPC ..... 333/1.1, 24.2
See application file for complete search history.

(56) References Cited

U.S. PATENT DOCUMENTS

| | | | |
|---|---|---|---|
| 6,696,901 | B1 | 2/2004 | Takeda et al. |
| 2006/0132255 | A1 | 6/2006 | Kawanami |
| 2006/0192627 | A1 | 8/2006 | Kocharyan |

FOREIGN PATENT DOCUMENTS

| | | | |
|---|---|---|---|
| JP | 54-115044 | A | 9/1979 |
| JP | 56-85901 | A | 7/1981 |
| WO | 00/59065 | A1 | 10/2000 |
| WO | 2004/084338 | A1 | 9/2004 |

OTHER PUBLICATIONS

Official Communication issued in International Patent Application No. PCT/JP2012/055636, mailed on Jun. 12, 2012.

*Primary Examiner* — Stephen Jones
(74) *Attorney, Agent, or Firm* — Keating & Bennett, LLP

(57) ABSTRACT

A non-reciprocal circuit device includes a magnetic core, a permanent magnet that applies a DC field to the magnetic core, a plurality of central conductors that are insulated from each other and cross each other at a specified angle, and at least one subsidiary conductor that is arranged on the magnetic core adjacent to at least one of the central conductors. The subsidiary conductor is magnetically coupled with the central conductor adjacent thereto via the magnetic core.

20 Claims, 8 Drawing Sheets

INVENTIVE

INVENTIVE

NON-RECIPROCAL CIRCUIT DEVICE AND RADIO COMMUNICATION TERMINAL DEVICE

BACKGROUND OF THE INVENTION

1. Field of the Invention

The present invention relates to a non-reciprocal circuit device, particularly a non-reciprocal circuit device, such as an isolator, a circulator or the like, used in a microwave band, and a radio communication terminal device.

2. Description of the Related Art

A non-reciprocal circuit device, such as an isolator, a circulator or the like has a characteristic of transmitting a signal in only a specified direction and of not transmitting a signal in the opposite direction. Based on such a characteristic, for example, a circulator is used in a transmitting and receiving circuit of a mobile communication device such as a cell phone.

In this type of circulator, a plurality of central conductors are arranged on a main surface of a magnetic core (ferrite core), and a DC field is applied to the ferrite core from a permanent magnet, thereby coupling the plurality of central conductors together. WO 00/59065 discloses that the pass-band of a circulator can be widened by providing a resonant circuit in addition to the central conductors. In recent years, however, various systems such as LTE are introduced to radio communication systems, and non-reciprocal circuit devices operable in a wider band are demanded to obtain simplified transmitting and receiving circuits.

SUMMARY OF THE INVENTION

Preferred embodiments of the present invention provide a non-reciprocal circuit device that achieves further widening of bandwidth and a radio communication terminal device.

A non-reciprocal circuit device according to a first preferred embodiment of the present invention includes a magnetic core; a permanent magnet that applies a DC field to the magnetic core; a plurality of central conductors that are arranged on the magnetic core to be insulated from each other and to cross each other at a specified angle; and at least one subsidiary conductor that is arranged on the magnetic core to be adjacent to at least one of the central conductors; and the subsidiary conductor is magnetically coupled with the central conductor adjacent thereto via the magnetic core.

A radio communication terminal device according to a second preferred embodiment of the present invention includes an antenna element; and the non-reciprocal circuit device connected to the antenna element.

In the non-reciprocal circuit device, one of the central conductors is coupled with another of the central conductors on the magnetic core, and a high-frequency signal input to the one of the central conductors propagates to the another of the central conductors and is output from the non-reciprocal circuit. This is an operation as a single-resonant circuit. In the non-reciprocal circuit device, the subsidiary conductor arranged on the magnetic core to be adjacent to one of the central conductors is magnetically coupled with the central conductor and resonates with the central conductor around a used frequency, so as to cause multi-resonance. Thus, the bandwidth is widened. In this moment, the magnetic coupling between the subsidiary conductor and the central conductor on the magnetic core enhances magnetic energy that contributes to non-reciprocal propagation of a high-frequency signal. Accordingly, the effective coupling between the central conductors is enhanced, and the bandwidth is widened.

According to various preferred embodiments of the present invention, by providing a subsidiary conductor in addition to central conductors, further widening of bandwidth is achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
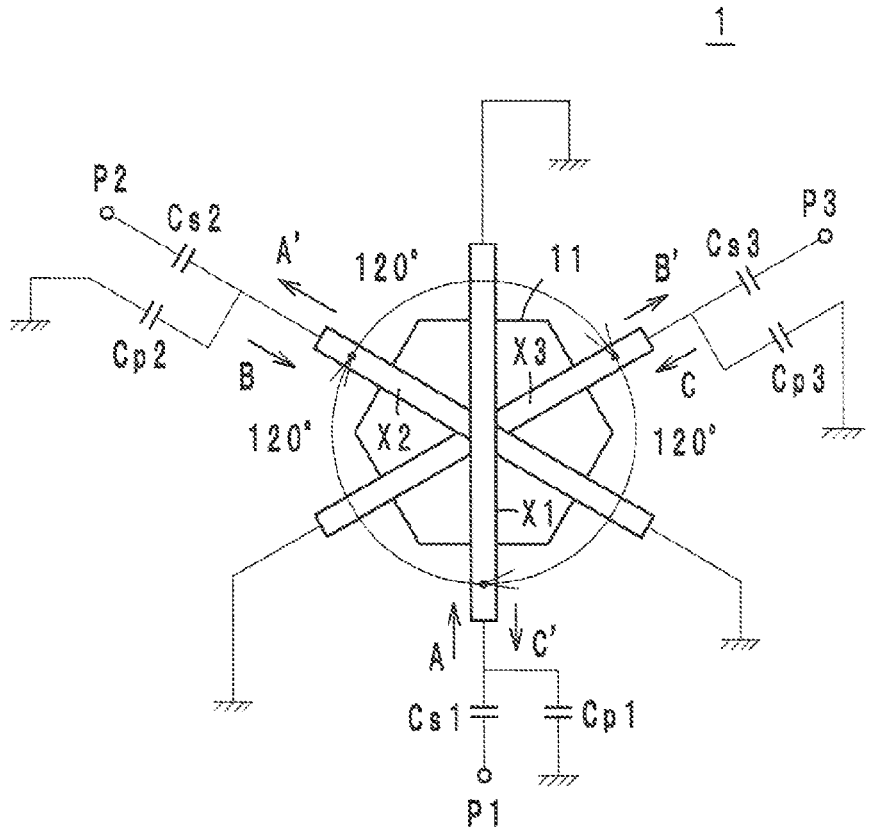
FIG. 1 is a circuit diagram of a basic circulator according to a preferred embodiment of the present invention.

Preferred embodiments of a non-reciprocal circuit device and a radio communication terminal device will be described below with reference to the accompanying drawings. In the drawings, the same members and elements are provided with the same reference numerals and characters, and redundant descriptions will be avoided.

First, the basic configuration of a circulator according to a preferred embodiment of the present invention is described with reference to FIG. 1. The circulator 1preferably includes a magnetic core (ferrite core) 11, and a first central conductor Xl, a second central conductor X2 and a third central conductor X3 that are disposed on a surface of the magnetic core 11 in insulated condition from each other. These central conductors X1, X2 and X3 are arranged to cross each other at 120 degrees. The central conductors X1, X2 and X3 are connected to input/output ports Pl, P2 and P3 via capacitance elements Cs1, Cs2 and Cs3, respectively, at respective first ends. Capacitance elements Cp1, Cp2 and Cp3 are connected in parallel to the capacitances Cs1, Cs2 and Cs 3, and the capacitance elements Cp1, Cp2 and Cp3 are grounded. Also, the other ends of the respective central conductors X1, X2 and X3 are grounded.

A DC field is applied to the circulator 1 of the above-described structure from a permanent magnet (not shown). As a result, a high-frequency signal A input to the input/output port P1 propagates to the second central conductor X2 that crosses the first central conductor X1 at an angle of 120 degrees, and is output from the input/output port P2 as a signal A'. A high-frequency signal B input to the input/output port P2 propagates to the third central conductor X3 that crosses the second central conductor X2 at an angle of 120 degrees, and is output from the input/output port P3 as a signal B'. A high-frequency signal C input to the input/output port P3 propagates to the first central conductor X1 that crosses the third central conductor X3 at an angle of 120 degrees, and is output from the input/output port P1 as a signal C'.

Figure 2:
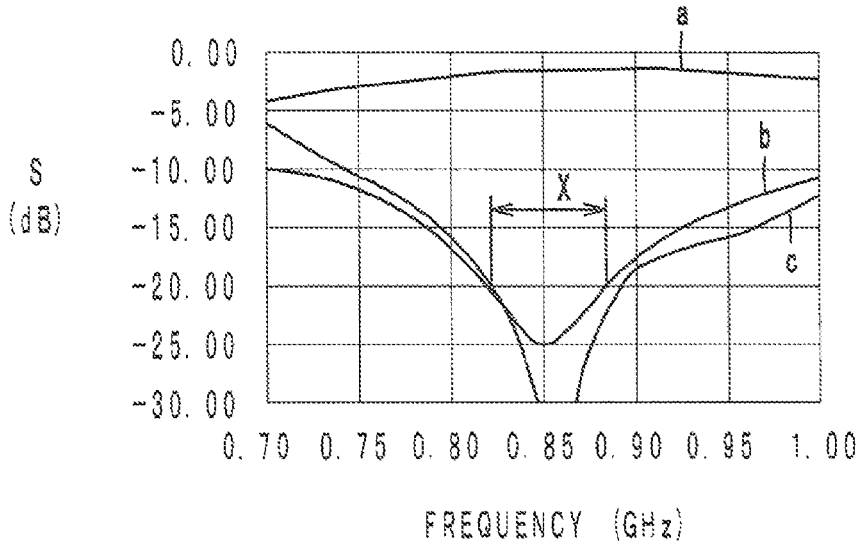
FIG. 2 is a graph showing characteristics of the circulator shown by FIG. 1.

FIG. 2 shows characteristics of the circulator 1. The curve a shows the forward loss characteristic. The curve b shows the forward reflection characteristic. The curve c shows the isolation characteristic. When −20 dB is intended, the circulator 1 is usable within a band shown by a range X.

Figure 3:
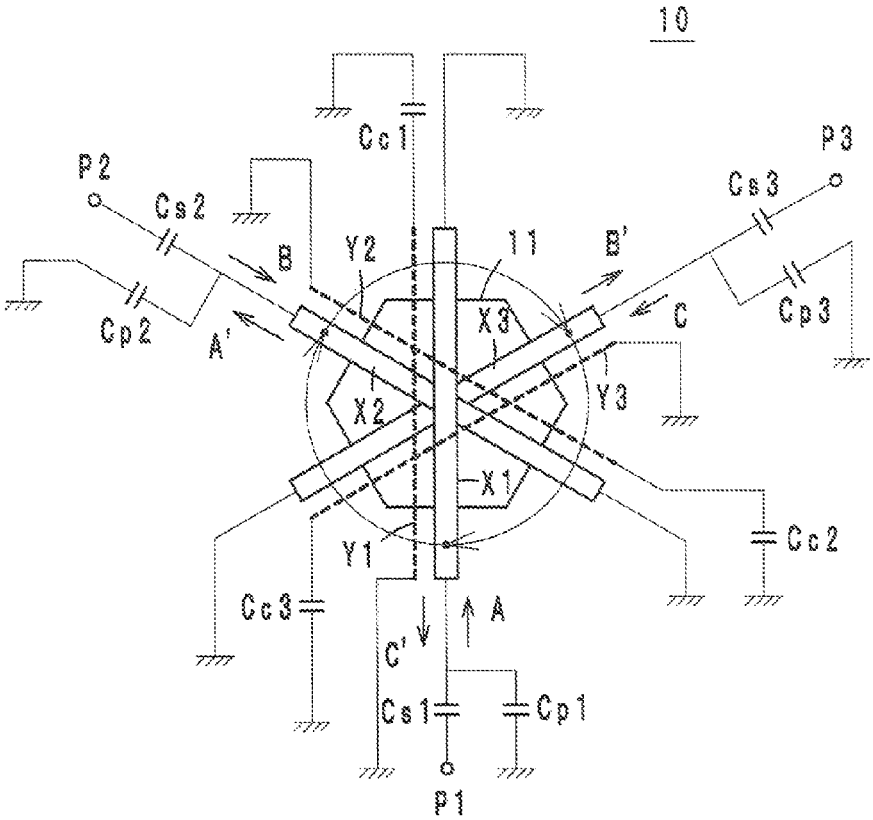
FIG. 3 is a circuit diagram of a circulator according to a preferred embodiment of the present invention.
Figure 4:
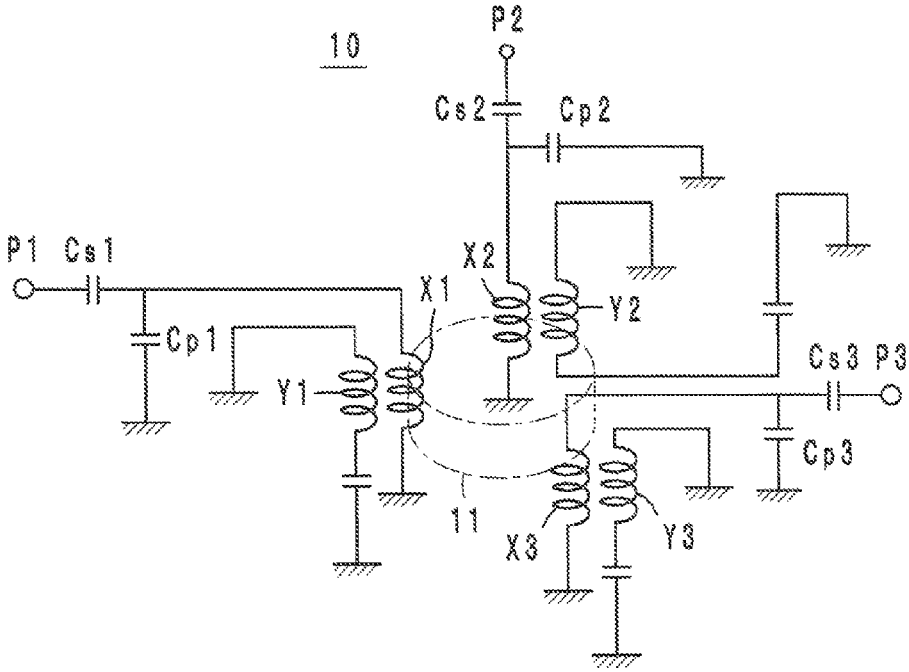
FIG. 4 is an equivalent circuit diagram of the circulator shown by FIG. 3.

FIGS. 3 and 4 show a circulator 10 according to a preferred embodiment of the present invention. The circulator 10 preferably includes a first subsidiary conductor Y1, a second subsidiary conductor Y2 and a third subsidiary conductor Y3 that extend in parallel or substantially in parallel to the first central conductor X1, the second central conductor X2 and the third central conductor X3, respectively. The subsidiary conductors Y1, Y2 and Y3 are grounded at respective first ends, and are grounded via capacitance elements Cc1, Cc2 and Cc3, respectively, at respective second ends. Each of the central conductors X1, X2 and X3 serves as an inductance element by itself, and by a DC field applied from a permanent magnet 15 (see FIG. 6), the central conductors X1 and X2 are coupled with each other via the respective inductance elements. Also, the central conductors X2 and X3 are coupled with each other via the respective inductance elements, and the central conductor X3 and X1 are coupled with each other via the respective inductance elements.

The subsidiary conductors Y1, Y2 and Y3, each of which serves as an inductance element by itself, and the capacitance elements Cc1, Cc2 and Cc3 define LC resonators, and the LC resonators are coupled with the respective adjacent central conductors X1, X2 and X3 on the magnetic core 11 via the magnetic field.

In the circulator 10 of the above-described structure, high-frequency signals propagate in the same ways as described in connection with the circulator 1, and this is an operation as a single resonator. Further, the subsidiary conductors Y1, Y2 and Y3, which are arranged adjacent to and magnetically coupled with the central conductors X1, X2 and X3, respectively, resonate around the used frequency, which causes multi-resonance. As a result, the bandwidth is widened. In this moment, the subsidiary conductors Y1, Y2 and Y3 are magnetically coupled with the central conductors X1, X2 and X3, respectively, on the magnetic core 11, which allows enhancement of the magnetic energy which contributes to non-reciprocal propagation of high-frequency signals. Accordingly, the non-reciprocal effective coupling among the central conductors X1, X2 and X3 is enhanced, and thus, the bandwidth is widened.

Figure 5:
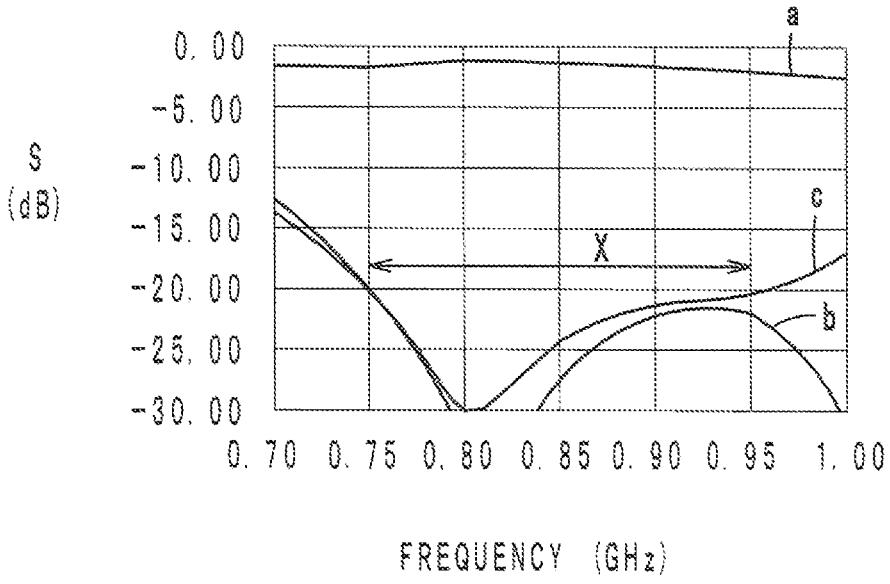
FIG. 5 is a graph showing characteristics of the circulator shown by FIG. 3.

FIG. 5 shows characteristics of the circulator 10. The curve a shows the forward loss characteristic. The curve b shows the forward reflection characteristic. The curve c shows the isolation characteristic. When −20 dB is intended, the circulator 10 is usable within a band shown by a range X. Compared with the graph of FIG. 2, it is clear that the circulator 10 has a wider bandwidth. Incidentally, the capacitance elements Cc1, Cc2 and Cc3 respectively provided for the subsidiary conductors Y1, Y2 and Y3 each have capacitance of about 8.1 pF, for example. The capacitance elements Cp1, Cp2 and Cp3 respectively provided for the central conductors X1, X2 and X3 each have capacitance of about 1.1 pF, for example. The capacitance elements Cs1, Cs2 and Cs3 each have capacitance of about 3.6 pF, for example. Each of the central conductors X1, X2 and X3 makes 1.5 turns around the magnetic core 11.

Figure 6A:
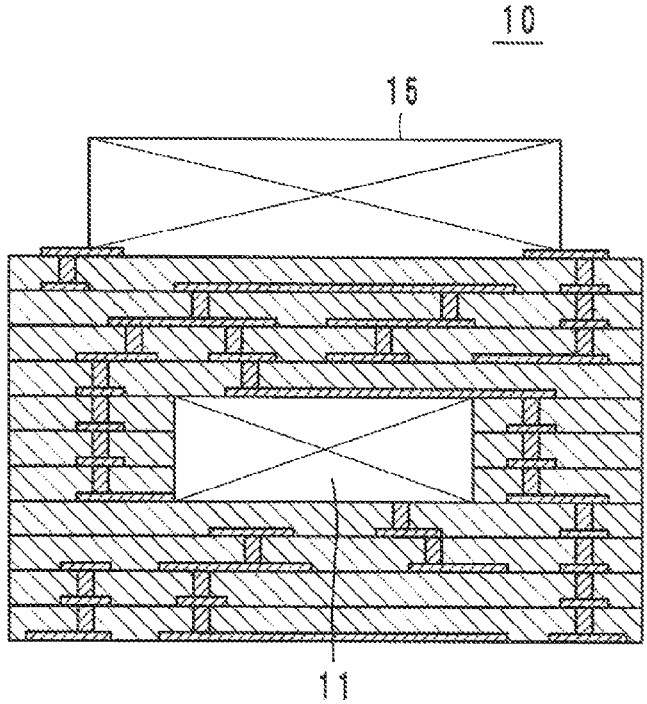
FIGS. 6A and 6B are schematic sectional views of the circulator shown by FIG. 3.
Figure 6B:
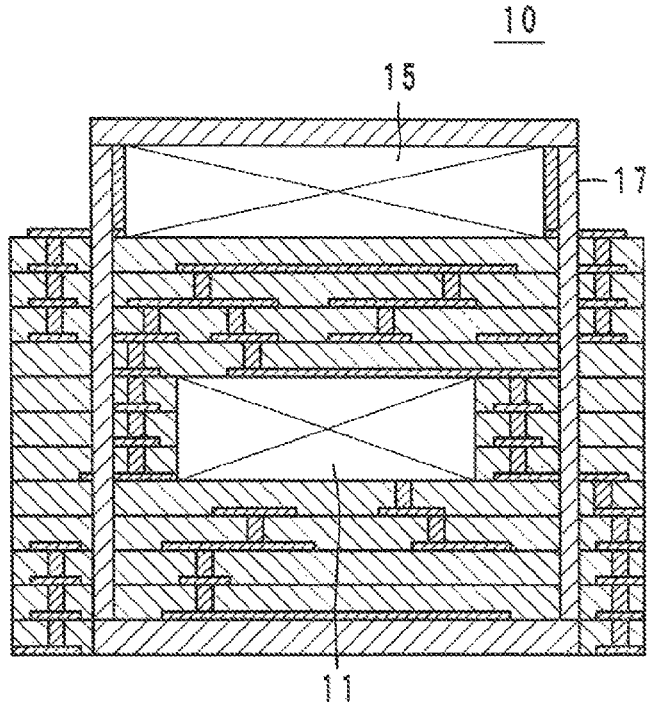

The circulator 10 is constructed as a laminate including the magnetic core 11, and FIGS. 6A and 6B schematically shows the construction. The laminate is constructed by depositing magnetic sheets, each of which includes conductors that define the central conductors and/or the subsidiary conductors on a front surface or a back surface, one upon another, and the magnetic core 11 is embedded in the center of the laminate. A permanent magnet 15 is located on the upper surface of the laminate, and a yoke 17 (see FIG. 6B) arranged to enclose the magnet 15 serves as a closed magnetic circuit. The conductors provided on different layers are electrically connected to one another by via-hole conductors. It is preferred that the subsidiary conductors are provided between the turns of the central conductors. In this case, by using the upper and lower layers of each turn of the central conductors, it is possible to arrange wiring such that the subsidiary conductors will not contact with the central conductors.

Figure 7:
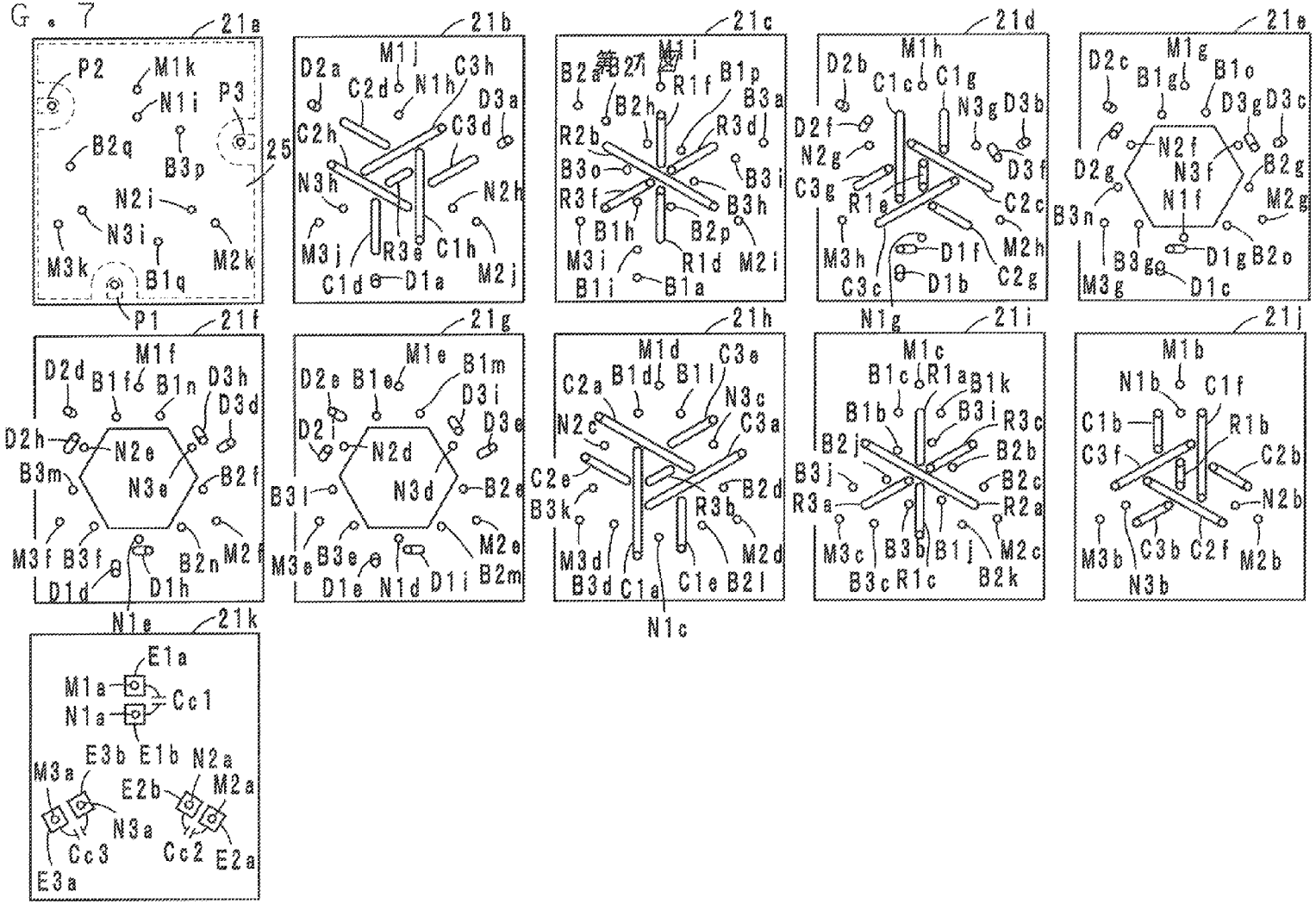
FIG. 7 shows plan views of respective layers of a laminate defining the circulator shown by FIG. 3.

Now, an example of the laminate of the circulator 10 is described with reference to FIG. 7. FIG. 7 shows sheets 21*a* to 21*k* which are to be stacked in this order from the bottom. With respect to the lowermost sheet 21*a*, conductors are located on the back surface. Small circles made in the sheets 21*a* to 21*k* show via-hole conductors. The via-hole conductors provided on the lowermost sheet 21*a* are for the connection to the conductors provided on the upper sheets, and the via-hole conductors provided on the other sheets 21*b* to 21*k* are for the connection to the conductors provided on the lower sheets. In order to avoid complication, reference numerals are provided for only some main via-hole conductors.

The conductors C1*a* to C1*h*, which are provided on the respective sheets as conductor films, define the first central conductor X1. The conductors C2*a* to C2*h* define the second central conductor X2. The conductors C3*a* to C3*h* define the third central conductor X3. The conductors R1*a* to R1*f* define the first subsidiary conductor Y1. The conductors R2*a* and R2*b* define the second subsidiary conductor Y2. The conductors R1*a* to R3*e* define the third subsidiary conductor Y3.

More specifically, on the back surface of the lowermost sheet 21*a*, input/output ports P1, P2 and P3, and a grounding conductor 25 are provided. The input/output port P1 is connected to one end of the conductor C1*a* provided on the sheet 21*h* via the conductor D1*a* provided on the sheet 21*b*, the via-hole conductor B1*a* provided on the sheet 21*c*, and the conductors D1*b* to D1*e* provided respectively on the sheets 21*d* to 21*g*. The other end of the conductor C1*a* is connected to one end of the conductor C1*b* provided on the sheet 21*j* via the via-hole conductor B1*b* provided on the sheet 21*i*. The other end of the conductor C1*b* is connected to one end of the conductor C1*c* provided on the sheet 21*d* via the via-hole conductors B1*c* to Big provided respectively on the sheets 21*i* to 21*e*. The other end of the conductor C1*c* is connected to one end of the conductor C1*d* provided on the sheet 21*b* via the via-hole conductor B1*h* provided on the sheet 21*c*. The other end of the conductor C1*d* is connected to one end of the conductor C1*e* provided on the sheet 21*h* via the via-hole conductor B1*i* provided on the sheet 21*c*, and the conductors D1*f* to D1*i* provided respectively on the sheets 21*d* to 21*g*. The other end of the conductor C1*e* is connected to one end of the conductor C1*f* provided on the sheet 21*j* via the via-hole conductor B1*j* provided on the sheet 21*i*. The other end of the conductor C1*f* is connected to one end of the conductor C1*g* provided on the sheet 21*d* via the via-hole conductors B1K to B1*o* provided respectively on the sheets 21*i* to 21*e*. The other end of the conductor C1*g* is connected to one end of the conductor C1*h* provided on the sheet 21*b* via the via-hole conductor B1*p* provided on the sheet 21*c*. The other end of the conductor C1*h* is connected to the grounding conductor 25 via the via-hole conductor B1*q* provided on the sheet 21*a*.

The input/output port P2 is connected to one end of the conductor C2*a* provided on the sheet 21*h* via the conductor D2*a* provided on the sheet 21*b*, the via-hole conductor B2*a* provided on the sheet 21*c*, and the conductors D2*b* to D2*e* provided respectively on the sheets 21*d* to 21*g*. The other end of the conductor C2*a* is connected to one end of the conductor C2*b* provided on the sheet 21*j* via the via-hole conductor B2*b* provided on the sheet 21*i*. The other end of the conductor C2*b* is connected to one end of the conductor C2*c* provided on the sheet 21*d* via the via-hole conductors B2*c* to B2*g* provided respectively on the sheets 21*i* to 21*e*. The other end of the conductor C2*c* is connected to one end of the conductor C2*d* provided on the sheet 21*b* via the via-hole conductor B2*h* provided on the sheet 21*c*. The other end of the conductor C2*d* is connected to one end of the conductor C2*e* provided on the sheet 21*h* via the via-hole conductor B2*i* provided on the sheet 21*c*, and the conductors D2*f* to D2*i* provided respectively on the sheets 21*d* to 21*g*. The other end of the conductor C2*e* is connected to one end of the conductor C2*f* provided on the sheet 21*j* via the via-hole conductor B2*j* provided on the sheet 21*i*. The other end of the conductor C2*f* is connected to one end of the conductor C2*g* provided on the sheet 21*d* via the via-hole conductors B2*k* to B2*o* provided respectively on the sheets 21*i* to 21*e*. The other end of the conductor C2*g* is connected to one end of the conductor C2*h* provided on the sheet 21*b* via the via-hole conductor B2*p* provided on the sheet 21*c*. The other end of the conductor C2*h* is connected to the grounding conductor 25 via the via-hole conductor B2*q* provided on the sheet 21*a*.

The input/output port P3 is connected to one end of the conductor C3*a* provided on the sheet 21*h* via the conductor D3*a* provided on the sheet 21*b*, the via-hole conductor B3*a* provided on the sheet 21*c*, and the conductors D3*b* to D3*e* provided respectively on the sheets 21*d* to 21*g*. The other end of the conductor C3*a* is connected to one end of the conductor C3*b* provided on the sheet 21*j* via the via-hole conductor B3*b* provided on the sheet 21*i*. The other end of the conductor C3*b* is connected to one end of the conductor C3*c* provided on the sheet 21*d* via the via-hole conductors B1*c* to B3*g* provided respectively on the sheets 21*i* to 21*e*. The other end of the conductor C3*c* is connected to one end of the conductor C3*d* provided on the sheet 21*b* via the via-hole conductor B3*h* provided on the sheet 21*c*. The other end of the conductor C3*d* is connected to one end of the conductor C3*e* provided on the sheet 21*h* via the via-hole conductor B3*i* provided on the sheet 21*c*, and the conductors D3*f* to D3*i* provided respectively on the sheets 21*d* to 21*g*. The other end of the conductor C3*e* is connected to one end of the conductor C3*f* provided on the sheet 21*j* via the via-hole conductor B3*j* provided on the sheet 21*i*. The other end of the conductor C3*f* is connected to one end of the conductor C3*g* provided on the sheet 21*d* via the via-hole conductors B3*j* to B3*n* provided respectively on the sheets 21*i* to 21*e*. The other end of the conductor C3*g* is connected to one end of the conductor C3*h* provided on the sheet 21*b* via the via-hole conductor B3*o* provided on the sheet 21*c*. The other end of the conductor C3*h* is connected to the grounding conductor 25 via the via-hole conductor B3*p* provided on the sheet 21*a*.

On the uppermost sheet 21*k*, electrodes E1*a* and E1*b* in order to mount the capacitance element Cc1, electrodes E2*a* and E2*b* that mount the capacitance element Cc2 and electrodes E3*a* and E3*b* that mount the capacitance element Cc3 are provided. The electrode E1*a* is connected to the grounding conductor 25 via the via-hole conductors M1*a* to M1*k* provided respectively on the sheets 21*k* to 21*a*. The electrode E1*b* is connected to one end of the conductor R1*a* provided on the sheet 21*i* via the via-hole conductors N1*a* and N1*b* provided respectively on the sheets 21*k* and 21*j*. The other end of the conductor R1*a* is connected to one end of the conductor Rib provided on the sheet 21*j*. The other end of the conductor Rib is connected to one end of the conductor R1*c* provided on the sheet 21*i*. The other end of the conductor R1*c* is connected to one end of the conductor R1*d* provided on the sheet 21*c* via the via-hole conductors N1*c* to N1*g* provided respectively on the sheets 21*h* to 21*d*. The other end of the conductor Rid is connected to one end of the conductor R1*e* provided on the sheet 21*d*. The other end of the conductor R1*e* is connected to one end of the conductor R1*f* provided on the sheet 21*c*. The other end of the conductor R1*f* is connected to the grounding conductor 25 via the via-hole conductors N1*h* and N1*i* provided respectively on the sheets 21*b* and 21*a*.

The electrode Eta is connected to the grounding conductor 25 via the via-hole conductors M2*a* to M2*k* provided respectively on the sheets 21*k* to 21*a*. The electrode E2*b* is connected to one end of the conductor R2*a* provided on the sheet 21*i* via the via-hole conductors N2*a* and N2*b* provided respectively on the sheets 21*k* and 21*j*. The other end of the conductor R2*a* is connected to one end of the conductor R2*b* provided on the sheet 21*c* via the via-hole conductors N2*c* to N2*g* provided respectively on the sheets 21*h* to 21*d*. The other end of the conductor R2*b* is connected to the grounding conductor 25 via the via-hole conductors N2*h* and N2*i* provided respectively on the sheets 21*b* and 21*a*.

The electrode E3*a* is connected to the grounding conductor 25 via the via-hole conductors M3*a* to M3*k* provided respectively on the sheets 21*k* to 21*a*. The electrode E3*b* is connected to one end of the conductor R3*a* provided on the sheet 21*i* via the via-hole conductors N3*a* and N3*b* provided respectively on the sheets 21*k* and 21*j*. The other end of the conductor R3*a* is connected to one end of the conductor R3*b* provided on the sheet 21*h*. The other end of the conductor R3*b* is connected one end of the conductor R3*c* provided on the sheet 21*i*. The other end of the conductor R3*c* is connected to one end of the conductor R3*d* via the via-hole conductors N3*c* to N3*g* provided respectively on the sheets 21*h* to 21*d*. The other end of the conductor R3*d* is connected to one end of the conductor R3*e* provided on the sheet 21*b*. The other end of the conductor R3*e* is connected to one end of the conductor R3*f* provided on the sheet 21*c*. The other end of the conductor R3*f* is connected to the grounding conductor 25 via the via-hole conductors N3*h* and N3*i* provided on the sheets 21*b* and 21*a*.

Next, non-limiting examples of incorporating the circulator 10 in a radio communication terminal device (cell phone) are described. FIGS. 8B and 8C show a first example of application to a transmitting and receiving circuit. The transmitting and receiving circuit includes a first system to be used in a low-frequency band (for example, 800 to 900 MHz) and a second system to be used in a high-frequency band (for example, 1800 to 1900 MHz).

Figure 8A:
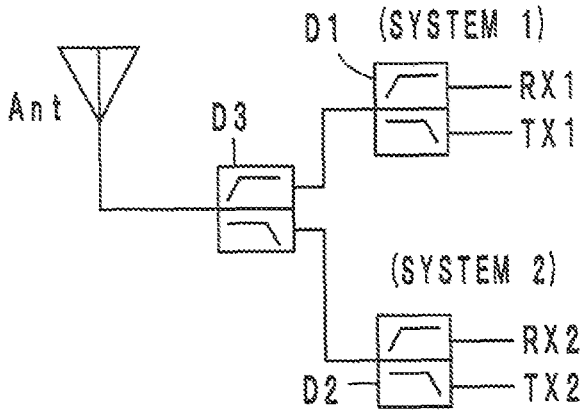
FIG. 8A PRIOR ART
FIGS. 8A and 8B show a first example of application to a transmitting and receiving circuit of a communication terminal device, FIG. 8A showing a block diagram of a conventional transmitting and receiving circuit and FIG. 8B showing a block diagram of a transmitting and receiving circuit including a circulator according to a preferred embodiment of the present invention.
Figure 8B:
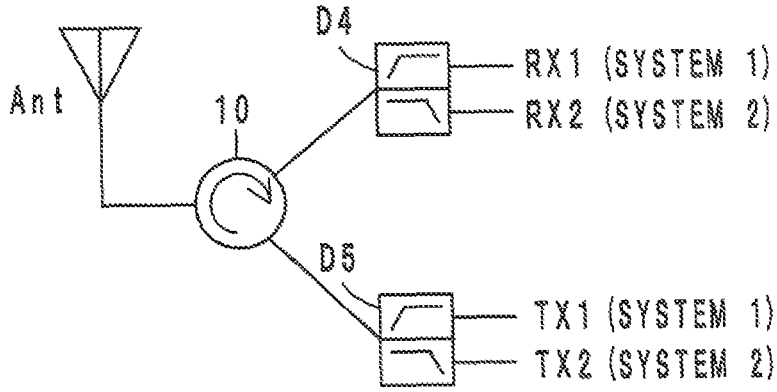

In a conventional structure as shown by FIG. 8A, a receiving terminal RX1 and a transmitting terminal TX1 are connected to a diplexer D3 via a duplexer D1, and a receiving terminal RX2 and a transmitting terminal TX2 are connected to the diplexer D3 via a duplexer D2. The diplexer D3 is connected to an antenna element Ant. Because a received signal and a transmitted signal are almost equal in frequency, each of the duplexers D1 and D2 need to have a high Q factor. In a receiving and transmitting circuit shown by FIG. 8B, on the other hand, receiving terminals RX1 and RX2 are connected to the circulator 10 via a diplexer D4, and transmitting terminal TX1 and TX2 are connected to the circulator 10 via a diplexer D5. The circulator 10 is connected to an antenna element Ant. The use of the wideband circulator 10 eliminates the need to use the costly duplexers D1 and D2.

Figure 9A:
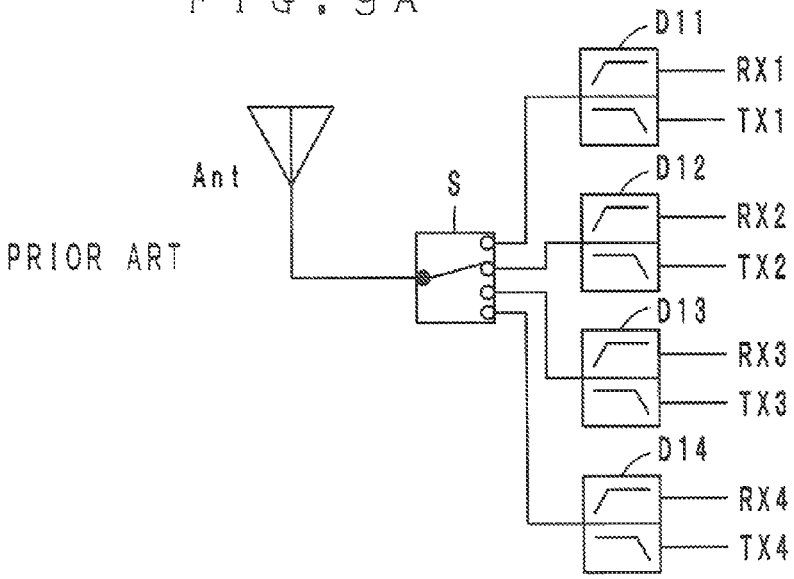
FIGS. 9A, 9B and 9C show a second example of application to a transmitting and receiving circuit of a communication terminal device, FIG. 9A showing a block diagram of a conventional transmitting and receiving circuit, FIG. 9B showing a block diagram of a transmitting and receiving circuit including a circulator according to a preferred embodiment of the present invention, and FIG. 9C showing a block diagram of another transmitting and receiving circuit including a circulator according to a preferred embodiment of the present invention.
Figure 9B:
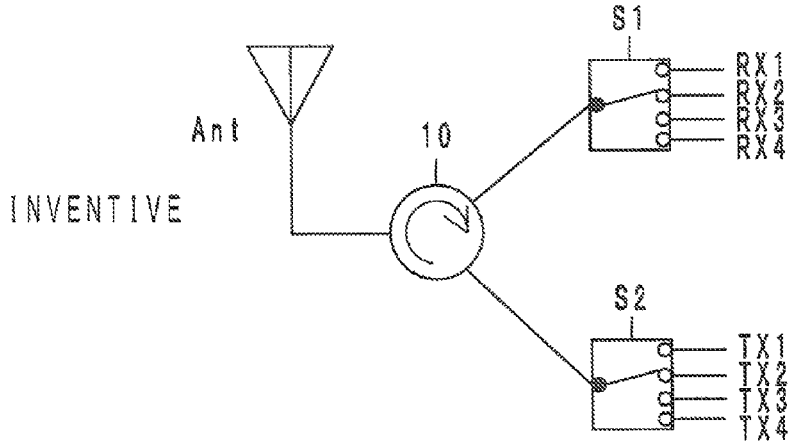
Figure 9C:
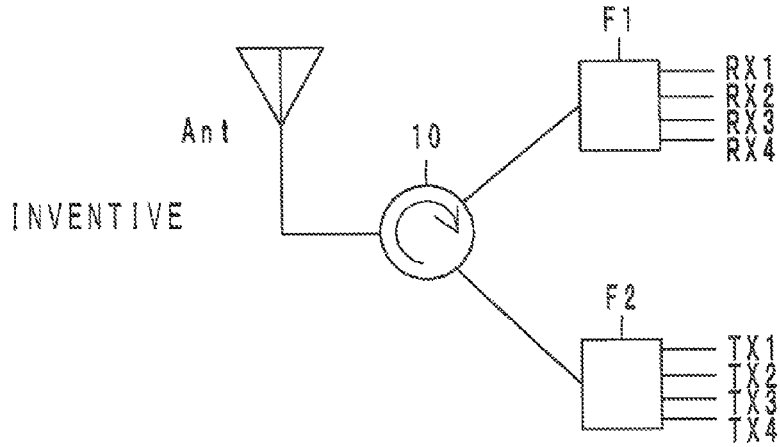

FIGS. 9B and 9C show a second example of application to a transmitting and receiving circuit. In the second example, the circulator 10 is incorporated in a transmitting and receiving circuit including four systems for four frequency bands. In a conventional structure as shown by FIG. 9A, a receiving terminal RX1 and a transmitting terminal TX1 are connected to a switching element S via a duplexer D11. A receiving terminal RX2 and a transmitting terminal TX2 are connected to the switching element S via a duplexer D12. A receiving terminal RX3 and a transmitting terminal TX3 are connected to the switching element S via a duplexer D13. A receiving terminal RX4 and a transmitting terminal TX4 are connected to the switching element S via a duplexer D14. The switching element S is connected to an antenna element Ant.

In a transmitting and receiving circuit shown by FIG. 9B, on the other hand, receiving terminals RX1 to RX4 are connected to a switching element S1, and transmitting terminals TX1 to TX4 are connected to a switching element S2. The switching elements S1 and S2 are connected to an antenna element Ant via the circulator 10.

In a transmitting and receiving circuit shown by FIG. 9C, receiving terminals RX1 to RX4 are connected to a filter F1, and transmitting terminals TX1 to TX4 are connected to a filter F2. The filters F1 and F2 are connected to an antenna element Ant via the circulator 10.

In the transmitting and receiving circuits shown by FIGS. 9B and 9C, the use of the wideband circulator 10 eliminates the need to use the costly duplexers D11 to D14 and contributes to simplification of the circuit configuration.

Figure 10:
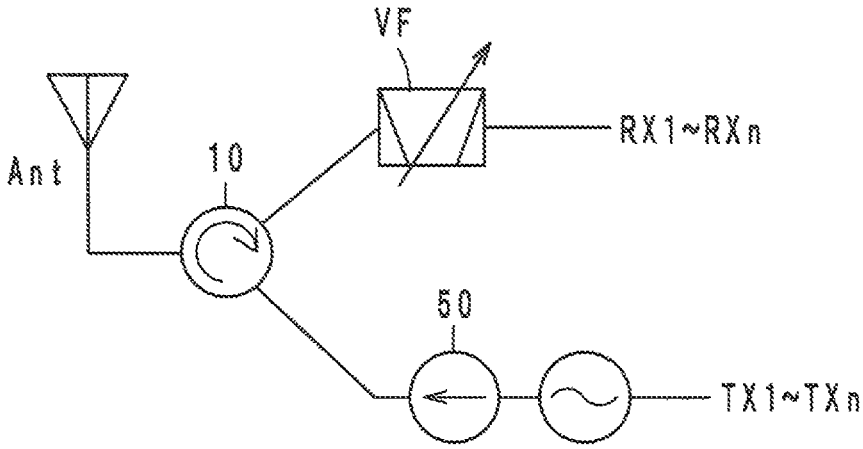
FIG. 10 is a block diagram of a third example of application to a transmitting and receiving circuit of a communication terminal device, the transmitting and receiving circuit including a circulator according to a preferred embodiment of the present invention.

FIG. 10 shows a third example of application to a transmitting and receiving circuit used in a cognitive radio (software radio) communication system. Receiving circuits RX1 to RXn are connected to the circulator 10 via a frequency variable band trap filter VF, and transmitting terminals TX1 to TXn are connected to the circulator 10 via an isolator 50. The circulator 10 is connected to an antenna element Ant.

In a cognitive radio communication system, the frequency used changes depending on circumstances. Therefore, assuming the possibility of coinstantaneous transmission and receipt of signals, switching elements are unsuited for use in the system. There may be an idea to divide the signals into a signal for transmission and a received signal by using a frequency variable duplexer. However, it is difficult to realize this idea. The use of the circulator 10 allows an additional use of the frequency variable band trap filter VF, which facilitates the fabrication of the transmitting and receiving circuit.

Non-reciprocal circuit devices and radio communication terminal devices according to the present invention are not limited to the preferred embodiments described above, and various changes and modifications are possible within the scope of the present invention.

It is not necessary that subsidiary conductors are additionally provided for all the central conductors. It is sufficient that a subsidiary conductor is disposed adjacent to at least one of the central conductors. The shapes and the structures of the central conductors and the subsidiary conductors may be selected from a wide range. Both ends of each subsidiary conductor may be grounded directly without any intervening capacitance elements. As examples of non-reciprocal circuit devices according to the present invention, circulators have been described. According to the present invention, it is also possible to construct an isolator having three input/output ports to one of which is connected to a matched load.

As described above, various preferred embodiments of the present invention are useful in non-reciprocal circuit devices and radio communication devices, and are advantageous in that the bandwidth is further widened.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A non-reciprocal circuit device comprising:

a magnetic core;

a permanent magnet arranged to apply a DC field to the magnetic core;

a plurality of central conductors arranged on the magnetic core, insulated from each other and crossing each other at a specified angle; and a subsidiary conductor that is arranged on the magnetic core and adjacent to at least one of the plurality of central conductors; wherein the subsidiary conductor is magnetically coupled with the at least one of the plurality of central conductors adjacent thereto via the magnetic core; and the subsidiary conductor is not directly physically and electrically connected to the at least one of the plurality of central conductors adjacent thereto.

2. A non-reciprocal circuit device according to claim 1, wherein the subsidiary conductor extends parallel or substantially parallel to the at least one of the plurality of central conductors adjacent thereto, and both ends of the subsidiary conductor are grounded.

3. A non-reciprocal circuit device according to claim 1, further comprising a laminate including the magnetic core, wherein:

the at least one of the plurality of the central conductors adjacent to the subsidiary conductor includes a plurality of turns in the laminate across a plurality of layers; and the subsidiary conductor is located between the plurality of turns of the at least one of the plurality of the central conductors.

4. A non-reciprocal circuit device according to claim 1, further comprising a capacitance element arranged between the subsidiary conductor and a ground, wherein the subsidiary conductor, which defines an inductance element, and the capacitance element define an LC resonator.

5. A non-reciprocal circuit device according to claim 1, wherein the non-reciprocal circuit device is one of a circulator and an isolator.

6. A non-reciprocal circuit device according to claim 1, wherein the plurality of central conductors cross each other at 120 degrees.

7. A non-reciprocal circuit device according to claim 1, further comprising capacitance elements arranged to connect the plurality of central conductors to input/output ports.

8. A non-reciprocal circuit device according to claim 1, further comprising a laminate including the magnetic core and magnetic sheets including conductors defining the plurality of central conductors and the subsidiary conductor disposed thereon.

9. A non-reciprocal circuit device according to claim 1, wherein the plurality of central conductors includes three central conductors and three of the subsidiary conductors are arranged parallel or substantially parallel to the three central conductors.

10. A non-reciprocal circuit device according to claim 9, wherein the three subsidiary conductors are grounded at respective first ends thereof and are grounded via capacitors at respective second ends thereof.

11. A non-reciprocal circuit device according to claim 9, wherein each of the three central conductors defines an inductance element and adjacent ones of the three central conductors are coupled to each other by the inductance element.

12. A non-reciprocal circuit device according to claim 11, further comprising capacitance elements arranged to define LC resonators with the inductance elements of the three central conductors.

13. A non-reciprocal circuit device according to claim 12, wherein the LC resonators are coupled to the respective adjacent central conductors via the magnetic field.

14. A radio communication terminal device comprising:

an antenna element; and a non-reciprocal circuit device according to claim 1; wherein the non-reciprocal circuit device is connected to the antenna element.

15. The radio communication terminal device according to claim 14, wherein the radio communication terminal device is a cell phone.

16. The radio communication terminal device according to claim 14, further comprising a first communication system to be used in a first frequency band and a second communication system to be used in a second frequency band that is higher than the first frequency band.

17. The radio communication terminal device according to claim 16, further comprising receiving terminals, transmitting terminals and first and second diplexers, wherein the non-reciprocal device is a circulator, the receiving terminals are connected to the circulator via the first diplexer, and the transmitting terminals are connected to the circulator via the second diplexer.

18. The radio communication terminal device according to claim 14, further comprising four communication systems to be used in four different frequency bands.

19. The radio communication terminal device according to claim 18, further comprising receiving terminals connected to a first switching element, and transmitting terminals connected to a second switching element, wherein the non-reciprocal device is a circulator and the first and second switching elements are connected to an antenna element via the circulator.

20. The radio communication terminal device according to claim 18, further comprising receiving terminals connected to a first filter, and transmitting terminals connected to a second filter, wherein the non-reciprocal device is a circulator and the first and second filters are connected to an antenna element via the circulator.

* * * * *